US012566009B2

(12) United States Patent
Cho et al.

(10) Patent No.: US 12,566,009 B2
(45) Date of Patent: Mar. 3, 2026

(54) AIR CONDITIONING APPARATUS AND METHOD OF CONTROLLING INDOOR PRESSURE USING SAME

(71) Applicant: SAMSUNG ELECTRONICS CO., LTD., Suwon-si (KR)

(72) Inventors: Mingi Cho, Suwon-si (KR); Kyunghoon Kim, Suwon-si (KR); Seojeong Kim, Suwon-si (KR); Sunggoo Kim, Suwon-si (KR); Changmin Seok, Suwon-si (KR); Seonghyun Yoon, Suwon-si (KR); Donggyu Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 440 days.

(21) Appl. No.: 18/113,699

(22) Filed: Feb. 24, 2023

(65) Prior Publication Data

US 2023/0194119 A1 Jun. 22, 2023

Related U.S. Application Data

(63) Continuation of application No. PCT/KR2021/010255, filed on Aug. 4, 2021.

(30) Foreign Application Priority Data

Sep. 16, 2020 (KR) ..... 10-2020-0119335

(51) Int. Cl.
*F24F 11/77* (2018.01)
*F24F 7/013* (2006.01)
(Continued)

(52) U.S. Cl.
CPC ..... *F24F 11/77* (2018.01); *F24F 7/013* (2013.01); *F24F 11/0001* (2013.01);
(Continued)

(58) Field of Classification Search
CPC .... F24F 11/0001; F24F 11/77; F24F 2110/40; F24F 2110/70; F24F 2110/64
See application file for complete search history.

(56) References Cited

U.S. PATENT DOCUMENTS 9,968,877 B2 5/2018 Chan et al.
10,086,322 B2 10/2018 Chan et al.
(Continued)

FOREIGN PATENT DOCUMENTS

JP 07-324797 A 12/1995
JP 3088587 B2 9/2000
(Continued)

OTHER PUBLICATIONS

Korean Office Action issued Jan. 22, 2025 for Korean Application No. 10-2020-0119335.
(Continued)

*Primary Examiner* — Allen R. B. Schult
(74) *Attorney, Agent, or Firm* — STAAS & HALSEY LLP

(57) ABSTRACT

A method comprising detecting an indoor carbon dioxide level; detecting an outdoor fine dust level; driving an air supply fan and an exhaust fan such that an air supply amount of the air supply fan is greater than an exhaust amount of the exhaust fan based on detected indoor carbon dioxide level and outdoor fine dust level; and performing a first indoor pressure control of detecting an indoor pressure and controlling the air supply fan and the exhaust fan. In the indoor pressure control, based on the detected indoor pressure being less than a first set value, a number of revolutions per minute of the exhaust fan is controlled to be decreased, and based on the detected indoor pressure is greater than or equal
(Continued)

to a second set value greater than the first set value, the number of revolutions per minute of the exhaust fan is controlled to be increased.

15 Claims, 4 Drawing Sheets

(51) Int. Cl.

| | |
|---|---|
| ***F24F 11/00*** | (2018.01) |
| ***F24F 11/64*** | (2018.01) |
| ***F24F 110/40*** | (2018.01) |
| ***F24F 110/64*** | (2018.01) |
| ***F24F 110/70*** | (2018.01) |
| *F24F 110/52* | (2018.01) |

(52) U.S. Cl.
CPC ..... *F24F 11/64* (2018.01); *F24F 2110/40* (2018.01); *F24F 2110/52* (2018.01); *F24F 2110/64* (2018.01); *F24F 2110/70* (2018.01)

(56) References Cited

U.S. PATENT DOCUMENTS

| | | | | |
|---|---|---|---|---|
| 10,343,097 | B2 | 7/2019 | Hung et al. | |
| 10,625,193 | B2 | 4/2020 | Chan et al. | |
| 2012/0003919 | A1* | 1/2012 | Wiener | B01D 46/446 454/338 |
| 2016/0045854 | A1 | 2/2016 | Hung et al. | |
| 2016/0047568 | A1 | 2/2016 | Chan et al. | |
| 2016/0048142 | A1 | 2/2016 | Chan et al. | |
| 2016/0048143 | A1 | 2/2016 | Chan et al. | |
| 2019/0022567 | A1 | 1/2019 | Chan et al. | |

FOREIGN PATENT DOCUMENTS

| | | | | | |
|---|---|---|---|---|---|
| JP | 2009168324 | A | * | 7/2009 | |
| JP | 2011-027360 | A | | 2/2011 | |
| JP | 6283004 | B2 | | 2/2018 | |
| KR | 10-0555235 | B1 | | 3/2006 | |
| KR | 10-0556676 | B1 | | 3/2006 | |
| KR | 10-0583004 | B1 | | 5/2006 | |
| KR | 10-1796296 | B1 | | 11/2017 | |
| KR | 10-2018-0014122 | A | | 2/2018 | |
| KR | 10-1858525 | B1 | | 5/2018 | |
| KR | 10-2018-0076392 | A | | 7/2018 | |
| KR | 10-2019-0005733 | A | | 1/2019 | |
| KR | 20190005733 | A | * | 1/2019 | F24F 11/77 |
| KR | 10-2019-0082343 | A | | 7/2019 | |
| KR | 10-2026341 | | | 9/2019 | |
| KR | 10-2026370 | B1 | | 10/2019 | |
| KR | 10-2033045 | B1 | | 10/2019 | |
| KR | 102056452 | B1 | * | 12/2019 | B03C 3/47 |
| KR | 10-2100916 | B1 | | 4/2020 | |
| KR | 10-2020-0095754 | | | 8/2020 | |

OTHER PUBLICATIONS

International Search Report issued in International Application No. PCT/KR2021/010255 dated Nov. 12, 2021.
Written Opinion issued in International Application No. PCT/KR2021/010255 dated Nov. 12, 2021.

* cited by examiner

AIR CONDITIONING APPARATUS AND METHOD OF CONTROLLING INDOOR PRESSURE USING SAME

CROSS-REFERENCE TO RELATED APPLICATION(S)

This application is a continuation application, under 35 U.S.C. § 111(a), of international application No. PCT/KR2021/010255, filed on Aug. 4, 2021, which claims priority under 35 U.S.C. § 119 to Korean Patent Application No. 10-2020-0119335, filed on Sep. 16, 2020, the disclosures of which are incorporated herein by reference in their entirety.

BACKGROUND

Field

The disclosure relates to an air conditioning apparatus and a method of controlling an indoor pressure using the same, and more particularly, to an air conditioning apparatus that is equipped with a function of detecting outdoor and indoor air states and maintaining the indoors in a positive pressure state effectively, and a method of controlling an indoor pressure using the same.

Description of the Related Art

An air conditioning apparatus is an apparatus that can manage the state of air, and the state of air is a concept in a broad sense indicating the contained amounts of oxygen and carbon dioxide, cleanliness, etc. as well as the temperature and humidity of air.

In the modern society, due to continuing air pollution, there is an increasing interest in the management of cleanliness of air of indoor spaces wherein people live. Accordingly, in an indoor space, the indoor air state is managed by installing an air purifier or a ventilation facility, etc. as an air conditioning apparatus.

In particular, on a day when the level of outdoor fine dust is high, there is a difficulty in ventilating the inside air, and even if an air purifier is equipped indoors, it is not possible to immediately ventilate air introduced from the outside, and there is a difficulty in purifying the air of the entire indoors.

Also, by a pressure difference from the indoors that is generated due to the wind pressure, the wind, or the temperature difference outside, the outdoor air can be introduced indoors. Or, in a situation wherein the indoor air should be discharged to the outside or ventilation is needed, the indoors gets in a negative pressure state, and thus there is a problem that the outdoor air that is not filtered is introduced indoors through cracks, etc. formed on a door, a window, or a structure.

Accordingly, there is a technical demand for an air conditioning apparatus that blocks introduction of fine dust from the outside, and is stably equipped with air purification and ventilation performances at the same time.

SUMMARY

According to an embodiment of the disclosure for achieving the aforementioned purpose, a method of controlling an indoor pressure comprises detecting an indoor carbon dioxide level, detecting an outdoor fine dust level, driving an air supply fan and an exhaust fan such that an air supply amount of the air supply fan is greater than an exhaust amount of the exhaust fan based on the detected indoor carbon dioxide level and the detected outdoor fine dust level, and performing an indoor pressure control of detecting an indoor pressure, and controlling the air supply fan and the exhaust fan based on the detected indoor pressure, wherein, in the indoor pressure control, based on the detected indoor pressure being less than a first set value, a number of revolutions per minute of the exhaust fan is controlled to be decreased, and based on the detected indoor pressure being greater than or equal to a second set value greater than the first set value, the number of revolutions per minute of the exhaust fan is controlled to be increased.

In this case, in the indoor pressure control, based on the detected indoor pressure being greater than or equal to the first set value and being less than the second set value, the detecting of the indoor carbon dioxide level, the detecting of the outdoor fine dust level, and the driving of the air supply fan and the exhaust fan based on the detected indoor carbon dioxide level and the detected outdoor fine dust level may be repeated.

Meanwhile, in the detecting of the indoor carbon dioxide level, based on the detected indoor carbon dioxide level being greater than or equal to a predetermined level, the air supply fan and the exhaust fan may be controlled such that the exhaust amount of the exhaust fan is identical to the air supply amount of the air supply fan.

Meanwhile, in the detecting of the outdoor fine dust level, based on the outdoor fine dust level being greater than or equal to a predetermined level, a fine dust filter in an air supply hole where the air supply fan is located may be turned to an on state.

Meanwhile, in the detecting of the outdoor fine dust level step, the outdoor fine dust level may be received by a communication apparatus.

Meanwhile, in the indoor pressure control, an outdoor pressure may be detected.

Also, the first set value and the second set value may be changed based on the indoor pressure and the outdoor pressure.

In this case, in the indoor pressure control, a sensor to detect the indoor pressure and the outdoor pressure may be arranged on a door or a window allowing air to flow from indoor to outdoor.

Meanwhile, the indoor pressure control may be a first indoor pressure control and the exhaust fan may include a kitchen ventilation fan in the kitchen, and the controlling method may further include driving the kitchen ventilation fan, driving the air supply fan, and performing a second indoor pressure control of detecting the indoor fine dust level and the indoor pressure, and controlling the air supply fan and the exhaust fan based on the indoor fine dust level and the indoor pressure.

In this case, in the second indoor pressure control, based on the detected indoor fine dust level being less than a third set value, and the detected indoor pressure being greater than or equal to the second set value, a number of revolutions per minute of the air supply fan may be controlled to be lowered.

Meanwhile, in the second indoor pressure control, based on the detected indoor fine dust level being greater than or equal to the third set value, and the detected indoor pressure being less than the second set value, a number of revolutions per minute of the air supply fan may be controlled to increase, and based on the detected indoor fine dust level being greater than or equal to the third set value, and the detected indoor pressure being greater than or equal to the second set value, the exhaust amount of the exhaust fan may be increased.

An air conditioning apparatus according to an embodiment of the disclosure includes an air supply fan to introduce air from outdoors to indoor, an exhaust fan to discharge air from the indoors to the outdoors, a sensor among a plurality of sensors to detect each of an indoor carbon dioxide level, an outdoor fine dust level, and an indoor pressure, and a processor to control the air supply fan and the exhaust fan based on detected values transmitted from the sensor part. The processor is configured to, based on detected levels associated with the detected values transmitted in association with the indoor carbon dioxide and the outdoor fine dust, control the air supply fan and the exhaust fan such that an air supply amount of the air supply fan is greater than an exhaust amount of the exhaust fan, and based on the detected indoor pressure being less than a first set value, control a number of revolutions per minute of the exhaust fan to be decreased, and based on the detected indoor pressure being greater than or equal to a second set value greater than the first set value, control the number of revolutions per minute of the exhaust fan to be increased.

In this case, the air conditioning apparatus may further include a fine dust filter to be arranged in an air supply hole where the air supply fan is located, the fine dust filter being turned on/off by the processor.

Meanwhile, a sensor to detect an outdoor pressure is among the plurality of sensors, and the sensor detecting the indoor pressure and the sensor detecting the outdoor pressure may be arranged on a door or a window communicating from the indoors to the outdoors.

Meanwhile, the exhaust fan may include a kitchen ventilation fan in the kitchen.

Meanwhile, a sensor to detect the indoor fine dust level is among the plurality of sensors.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
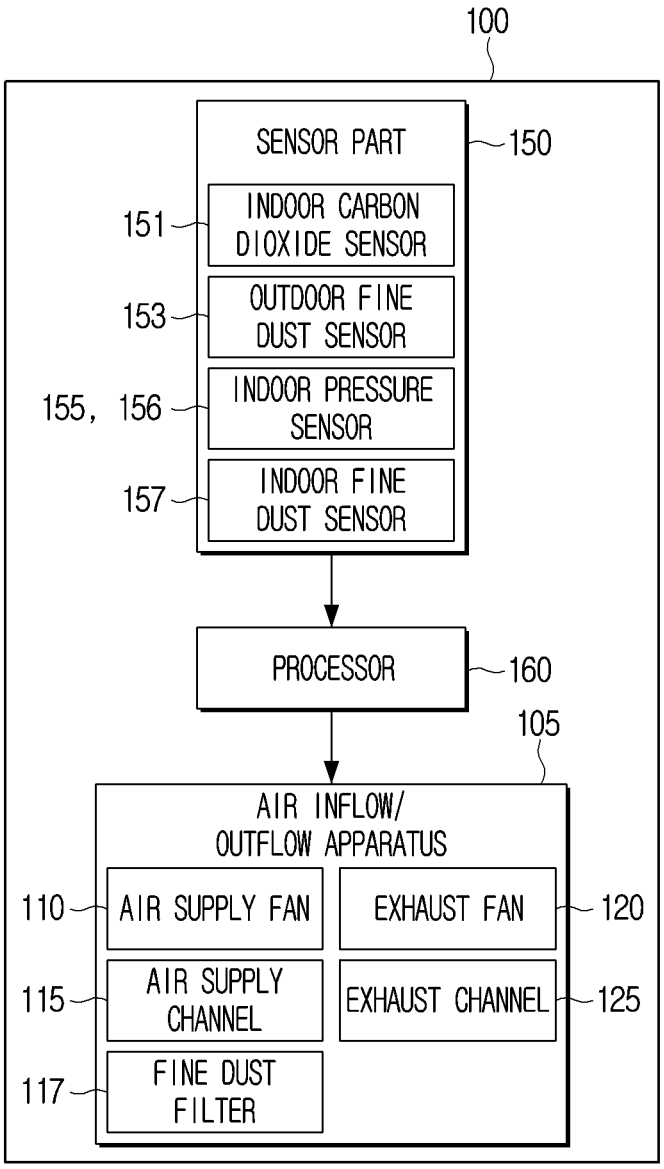
FIG. 1 is a block diagram illustrating a configuration of an air conditioning apparatus according to an embodiment of the disclosure.

First, terms used in this specification will be described briefly, and then the disclosure will be described in detail.

As terms used in the embodiments of the disclosure, general terms that are currently used widely were selected as far as possible, in consideration of the functions described in the disclosure. However, the terms may vary depending on the intention of those skilled in the art who work in the pertinent field, previous court decisions, or emergence of new technologies, etc. Also, in particular cases, there may be terms that were designated by the applicant on his own, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

In addition, various modifications may be made to the embodiments of the disclosure, and there may be various types of embodiments. Accordingly, specific embodiments will be illustrated in drawings, and the embodiments will be described in detail in the detailed description. However, it should be noted that the various embodiments are not for limiting the scope of the disclosure to a specific embodiment, but they should be interpreted to include all modifications, equivalents, or alternatives of the embodiments included in the ideas and the technical scopes disclosed herein. Meanwhile, in case it is determined that in describing embodiments, detailed explanation of related known technologies may unnecessarily confuse the gist of the disclosure, the detailed explanation will be omitted.

Further, terms such as "first," "second," and the like may be used to describe various components, but the components are not intended to be limited by the terms. The terms are used only to distinguish one component from another component. For example, a first component may be called a second component, and a second component may be called a first component in a similar manner, without departing from the scope of the disclosure.

Also, singular expressions also include plural expressions, as long as they do not obviously mean differently in the context. In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Hereinafter, the embodiments of the disclosure will be described in detail with reference to the accompanying drawings, such that those having ordinary skill in the art to which the disclosure belongs can easily carry out the disclosure. However, it should be noted that the disclosure may be implemented in various different forms, and is not limited to the embodiments described herein. Also, in the drawings, parts that are not related to explanation were omitted, for explaining the disclosure clearly, and throughout the specification, similar components were designated by similar reference numerals.

For resolving the aforementioned problem, the disclosure provides an air conditioning apparatus that is equipped with a function of detecting outdoor and indoor air states and maintaining the indoors in a positive pressure state effectively, and a method of controlling an indoor pressure using the same.

Hereinafter, the embodiments of the disclosure will be described in more detail with reference to the accompanying FIG. 1 to FIG. 4.

FIG. 1 is a block diagram illustrating a configuration of an air conditioning apparatus 100 according to an embodiment of the disclosure.

The air conditioning apparatus 100 according to an embodiment of the disclosure may include a sensor part 150, a processor 160, and an air inflow/outflow apparatus 105.

The air conditioning apparatus 100 is an apparatus managing an air state, and the air state may be a concept including the temperature, the humidity, the oxygen and carbon dioxide concentration, the fine dust concentration, etc. As examples of the air conditioning apparatus 100, there are electronic apparatuses such as an air conditioner for heating and cooling, an outdoor unit of an air conditioner, an air purifier, etc., and ventilation facilities such as a kitchen hood, a ventilation facility for a bathroom, etc. Also, by installing the air conditioning apparatus 100 from the construction stage of a building or constructing a building by preparing a facility for installing the air conditioning apparatus 100 in advance, the air state of the entire indoors can be effectively managed afterwards.

Although not illustrated in the drawings, the air conditioning apparatus 100 may further include components such as a communicator, a controller, a power supply, etc. other than the components in FIG. 1. In particular, because of worsening air pollution and development of technologies, there is a demand for improving the performance of the air conditioning apparatus 100, and accordingly, various functions for effectively managing the inside air quality while having additional performances may be added to the air conditioning apparatus 100, other than the functions for simply providing air to the inside and discharging the inside air to the outside. Also, with the development of electronic communication technologies, the air conditioning apparatus 100 can be controlled precisely to fit a user, and situations such as the outdoor fine dust level, the atmospheric pressure, the weather, etc. can be transmitted in real time from the outside of the air conditioning apparatus 100.

The indoors wherein the air conditioning apparatus 100 is installed may be in a situation wherein air flow with the outdoors is restricted. For example, in a situation wherein the fine dust concentration in the air is high due to air pollution, the outside fine dust can be introduced into the indoors if a door or a window communicating from the indoors to the outdoors is opened. Thus, a user can restrict the air flow between the indoors and the outdoors by maintaining a state wherein a door or a window is not opened.

The sensor part 150 may among a plurality of sensors detecting each of the indoor carbon dioxide level, the outdoor fine dust level, and the indoor pressure.

An indoor carbon dioxide sensor 151 may detect the indoor carbon dioxide level. As described above, in a situation wherein the air flow between the indoors and the outdoors is restricted, the indoor carbon dioxide level can increase due to various factors such as breathing of a user indoors, driving of home appliances, a microwave oven, use of a combustion appliance such as a candle, a pet's breathing, etc.

If the level of the indoor carbon dioxide concentration becomes higher than a specific value, the user may feel inconvenience and may have a problem in breathing, and may thus have a headache and have deteriorated concentration, and sleepiness may be induced. Carbon dioxide concentration in the air varies according to the weather and the environment, but it is approximately 400 ppm. There would not be a big problem if the indoor carbon dioxide concentration is between 700 ppm and lower than 1,000 ppm, but if the concentration exceeds this range, the aforementioned problem may occur.

The indoor carbon dioxide sensor 151 may use infrared rays or chemical gas, and for example, it may measure the indoor carbon dioxide concentration by radiating infrared rays of a specific frequency absorbed by carbon dioxide in the air, and measuring the amount of the infrared rays that are detected without being absorbed by carbon dioxide particles. However, the disclosure is not limited thereto, and the indoor carbon dioxide sensor 151 may be a sensor that can detect the carbon dioxide concentration by various methods.

For reference, in the disclosure, carbon dioxide concentration is suggested as an example of an index that detects an indoor air state, but the disclosure may further include a sensor detecting the concentration of substances that pollute the indoor air such as radon, volatile organic compounds (VOCs), formaldehyde, etc., and if the detected concentration of a pollutant is measured to be greater than or equal to a reference value, the processor 160 may drive the air inflow/outflow apparatus 105 as will be described below.

An outdoor fine dust sensor 153 may detect the level of outdoor fine dust which is the outside distinguished from the indoors wherein the air conditioning apparatus 100 is installed. Fine dust may generally refer to dust that may be generated by combustion of chemical fuels such as coal, petroleum, etc., or may be discharged from factories, cars, etc., and of which particle sizes are small in micrometer (μm) units. Fine dust may enter the body of a user through the user's respiratory organ, etc. through the air that the user breathes, and it has a risk of causing respiratory diseases and arrhythmia, heart diseases, nervous diseases, etc.

The outdoor fine dust sensor 153 may be arranged on a door or a window communicating from an outer wall or the indoors of a structure to the outdoors. Or, as a society-based system providing detailed fine dust levels according to districts exists recently, the outdoor fine dust level can be transmitted from the outside by a communication apparatus.

Indoor pressure sensors 155, 156 may detect an absolute value of an indoor pressure, or detect a relative value which is an indoor pressure difference compared to the outdoor pressure. Specifically, as the outdoor pressure is calculated based on 1 Pa based on the atmospheric pressure, the indoor pressure sensors 155, 156 may detect only the indoor pressure, and provide the detection value to the processor 160. Alternatively, as the outdoor pressure may vary according to the altitude of a structure, the weather, the wind, etc., the indoor pressure sensors 155, 156 may detect a pressure difference by measuring the outdoor pressure and the indoor pressure. Also, like the outdoor fine dust sensor 153, the indoor pressure sensors 155, 156 may receive outdoor state information necessary for predicting the outdoor pressure from the outside by a communication apparatus.

An indoor fine dust sensor 157 may detect the indoor fine dust. The indoor fine dust may be introduced from the outdoors, or it may be generated autonomously indoors. The indoor fine dust sensor 157 may detect the indoor fine dust level in real time, and provide the detection value to the processor 160.

The processor 160 may control the air inflow/outflow apparatus 105 based on a detection value transmitted from the sensor part 150. The operation of the processor 160 of driving the air inflow/outflow apparatus 105 according to a detection value will be described in detail after FIG. 3.

The air inflow/outflow apparatus 105 may include an air supply fan 110, an exhaust fan 120, an air supply channel 115, an exhaust channel 125, and a fine dust filter 117.

The air supply fan 110 may be arranged in the air supply channel 115, and introduce air from the outdoors to the indoors, and the exhaust fan 120 may be arranged in the exhaust channel 125, and discharge air from the indoors to the outdoors.

The air supply channel 115 and the exhaust channel 125 may be installed on the ceiling, the wall surface, or the bottom of a structure, and in the construction stage of the structure, they may be installed as air inflow/outflow facilities inside the structure together with electrical facilities and drainage facilities. Alternatively, the air inflow/outflow apparatus 105 may be carried out as a home appliance including a structure connected to the outdoors, like an air conditioner for heating and cooling.

The fine dust filter 117 may be arranged in the air supply channel 115, and may be turned on/off by the processor 160. The fine dust filter 117 may be a high efficiency particulate air (HEPA) filter that is for purifying the air introduced from the outdoors to the indoors, and filters fine dust or germs, etc., and it may be a deodorization filter or a mechanical filter, or it may be a filter wherein two or more filters are combined. The fine dust filter 117 may need to be periodically replaced, and may be arranged in the air supply channel 115 such that the user can replace it easily. As the fine dust filter 117 can have a structure that is turned on/off, it can be electronically controlled.

Figure 2:
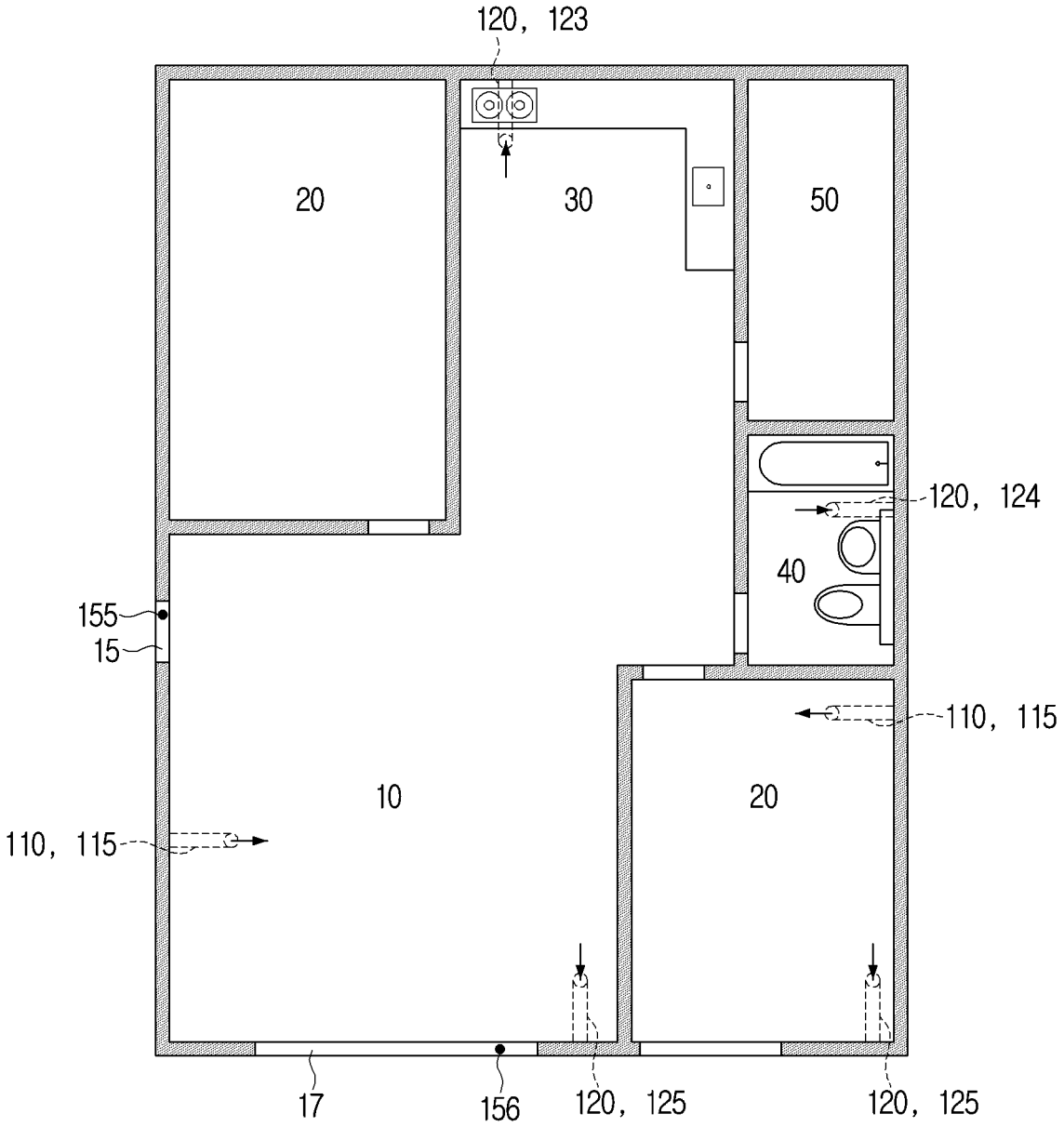
FIG. 2 is a plan view illustrating a structure wherein some components of an air conditioning apparatus according to an embodiment of the disclosure are arranged indoors.

FIG. 2 is a plan view illustrating a structure wherein the air inflow/outflow apparatus 105 according to an embodiment of the disclosure is arranged indoors.

Referring to FIG. 2, the exhaust fan 120 of the disclosure may include a kitchen ventilation fan 123 and a bathroom ventilation fan 124.

The structure in FIG. 2 is a drawing that indicates a plurality of sections of a structure for a residential purpose according to uses, for the convenience of explanation, and is illustrated to include a living room 10, a bedroom 20, a kitchen 30, a bathroom 40, and a utility room 50. However, this is merely an example, and some sections may be excluded or added, or one section may realize two or more uses.

Also, the air conditioning apparatus 100 of the disclosure may be applied to various indoor structures such as a commercial facility, a public facility, a bank, a hospital, etc. which are not for a residential purpose, and the structures may comprise of only one section. However, hereinafter, explanation will be described based on the structure for a residential purpose in FIG. 2, for the convenience of explanation.

The exhaust channel 125 and the air supply channel 115 may respectively exist as a plurality of channels. The air supply channel 115 and the exhaust channel 125 may be arranged in sections of which areas that they occupy in a structure are big such as the living room 10 or the bedroom 20, or in a section wherein the user spends the most time.

The air supply channel 115 and the exhaust channel 125 may be arranged to be distanced from each other. Since the air supply fan 110 and the exhaust fan 120 may be driven simultaneously, as the interval between the air supply channel 115 and the exhaust channel 125 becomes farther, air inside a structure can be circulated effectively.

The exhaust fan 120 may include the kitchen ventilation fan 123. In this case, the hood of the kitchen 30 may be the exhaust channel 125. The kitchen ventilation fan 123 may be driven when the user uses an electronic product, or cooks or has a meal in the kitchen 30. Also, the kitchen ventilation fan 123 can remove the dust, the smoke, or the odor, etc. in the air of the kitchen 30 by sucking in the air of the kitchen 30 and discharging it to the outside.

The exhaust fan 120 may include the bathroom ventilation fan 124. In general, the bathroom 40 has a function of a toilet, and the humidity in the air may become higher when the bathroom 40 is used, and thus the bathroom ventilation fan 124 may be driven and remove the humidity or the odor, etc. in the air of the bathroom 40.

The kitchen ventilation fan 123 and the bathroom ventilation fan 124 may be driven by the user depending on needs, and as they suck in the air of the inside, they may bring a change to the inside pressure. Regarding such a change, detailed explanation will be described with reference to FIG. 4 with the driving of the kitchen ventilation fan 123 as an example.

The air supply fan 110 and the exhaust fan 120 may include fans for air-blowing of various electronic apparatuses inducing outdoor and indoor air flows such as an air purification facility, an air conditioner for heating and cooling, etc., and may transmit or receive a driving signal by the processor 160.

The indoor pressure sensors 155, 156 may respectively be arranged on a door 15 or a window 17 communicating from the indoors to the outdoors. As described above, the indoor pressure sensors 155, 156 may also detect an outdoor pressure, and may detect a positive pressure state of a relative indoor pressure compared to the outdoor pressure, and thus the indoor pressure sensors 155, 156 may be arranged on the front door 15 or the window 17 communicating from the indoors to the outdoors, and may simultaneously detect the indoor and outdoor pressures effectively.

Although not illustrated in the drawings, the air inflow/outflow apparatus 105 may include an outdoor unit of an air conditioner communicating from the indoors to the outdoors, or include a main body to which the air supply channel 115 and the exhaust channel 125 are connected and which forms the exterior, and the outdoor unit of the air conditioner or the main body may be arranged in the utility room 50.

Figure 3:
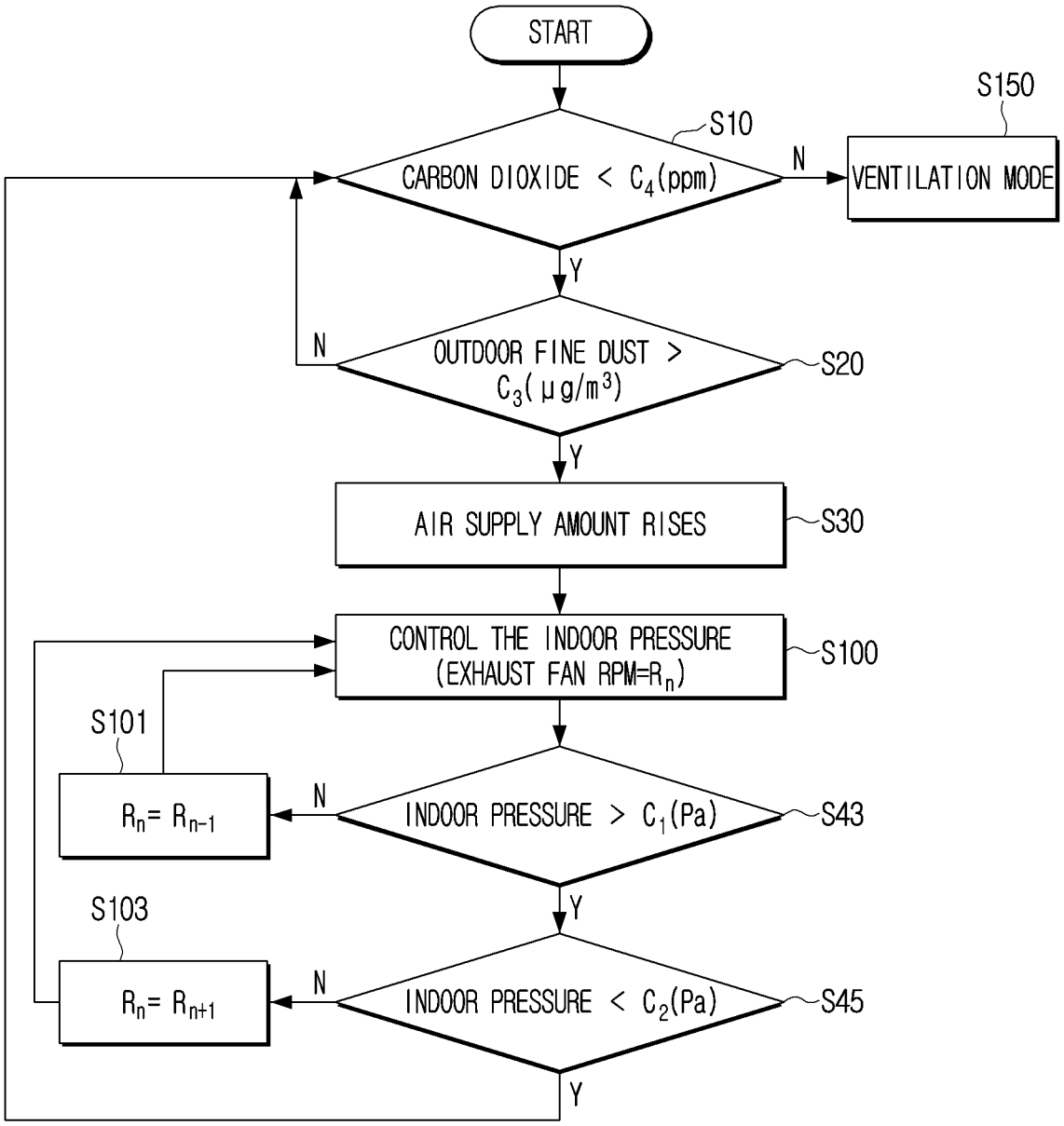
FIG. 3 is a block diagram illustrating a method of controlling an indoor pressure according to an embodiment of the disclosure.

FIG. 3 is a block diagram illustrating a method of controlling an indoor pressure according to an embodiment of the disclosure.

Referring to FIG. 3, the method of controlling an indoor pressure according to the disclosure may include a first detection operation S10, a second detection operation S20, an air supply amount raising operation S30, and a first indoor pressure control operation S100.

Specifically, in the indoor pressure controlling method, if the carbon dioxide level is less than a fourth set value (referred to as $C_4$ hereinafter) ppm in the first detection operation S10, the method proceeds to the second detection operation S20, and if the outdoor fine dust level is greater than or equal to a third set value $C_3$ μm/m$^3$ in the second detection operation S20, the method goes through the air supply amount raising operation S30 and proceeds to the first indoor pressure control operation S100. Hereinafter, proceedings according to the detection results in the first detection operation and the second detection operation, and the first indoor pressure control operation S100 will be explained.

In the first detection operation S10, the indoor carbon dioxide level may be detected. The indoor carbon dioxide sensor 151 may transmit the detected carbon dioxide level to the processor 160, and the processor 160 may identify whether the indoor carbon dioxide level is less than $C_4$. As described above, if the indoor carbon dioxide level exceeds 700 ppm to 1,000 ppm, the user may feel inconvenience and may have a problem in breathing, and thus $C_4$ may be a value between 700 and 1,000, or it may be changed by the user's setting.

Suggesting a case wherein the indoor carbon dioxide level increases as an example, in case there is active air exchange between the indoors and the outdoors, for example, in a situation wherein a door or a window communicating to the outdoors is opened or a ventilation facility is driven, the indoor carbon dioxide level may be maintained to be a level that is similar to or higher than the outdoors. However, in case a door or a window is not opened for the reason of outdoor fine dust, etc., that is, in a situation wherein active air exchange between the indoors and the outdoors does not occur, carbon dioxide generated indoors may be accumulated, and the carbon dioxide level may rise.

If the indoor carbon dioxide level is greater than or equal to $C_4$, the indoor pressure controlling method may proceed to a ventilation mode S150.

In the ventilation mode S150, the processor 160 controls the air supply fan 110 and the exhaust fan 120 such that the exhaust amount of the exhaust fan 120 is identical to the air supply amount of the air supply fan 110, and thereby induce the indoor pressure to be formed to be identical or similar to the outdoor pressure, and accordingly, air circulation between the outdoors and the indoors can be maintained to be active.

When a specific time passes in the ventilation mode S150, the indoor carbon dioxide level may become lower. In this case, the indoor pressure controlling method may return to the first detection operation S10.

Then, if the indoor carbon dioxide level is less than $C_4$ in the first detection operation S10, the indoor pressure controlling method may proceed to the second detection operation S20.

In the second detection operation S20, the outdoor fine dust level may be detected. The processor 160 may receive the outdoor fine dust level by the outdoor fine dust sensor 153, and identify whether the outdoor fine dust level is greater than or equal to $C_3$. If the fine dust level in the air exceeds 80 μm/m$^3$, a problem may occur in the respiratory organ, and thus $C_3$ may be a value between 81 and 150. However, the value of $C_3$ may be set differently according to the user and the place, and it may also be changed by the user's setting.

If the outdoor fine dust level is less than $C_3$ in the second detection operation S20, the indoor pressure controlling method may return to the first detection operation S10. The reason for this is that, as the outdoor air is deemed to be in a clean state if the outdoor fine dust level is less than $C_3$, there is no need to block the outdoor air from being introduced into the indoors. Thus, the air conditioning apparatus 100 may regard a state wherein the outdoor fine dust level is less than a predetermined set value and the indoor carbon dioxide level is less than a predetermined set value as a stand-by state or a detection state. Also, although not illustrated in the drawings, the ventilation mode S150 may be operated in another embodiment.

If the outdoor fine dust level is greater than or equal to $C_3$ in the second detection operation S20, the indoor pressure controlling method may proceed to the air supply amount raising operation S30.

In the air supply amount raising operation S30, the air supply fan 110 and the exhaust fan 120 may be driven such that the air supply amount of the air supply fan 110 is greater than the exhaust amount of the exhaust fan 120. In the air supply amount raising operation S30, the processor 160 may raise the indoor pressure by controlling the air supply amount to be relatively greater than the exhaust amount, and thereby make the indoor pressure a positive pressure state, such that the outdoor air is not introduced into the indoors based on the detected levels in the first detection operation S10 and the second detection operation S20.

If the outdoor fine dust level is greater than or equal to $C_3$, the fine dust filter 117 in the air supply hole may get in an on state. As the fine dust filter 117 needs to be periodically replaced, the fine dust filter 117 needs to be maintained in an on state only when it is needed, and the fine dust filter 117 may raise the cleanliness of air introduced from the outdoors to the indoors by being turned on/off according to whether the outdoor fine dust level is greater than or equal to a predetermined level.

In the indoor pressure controlling method, a change in the indoor pressure by the air supply amount raising operation S30 may be detected, and the indoor pressure controlling method may proceed to the first indoor pressure control operation S100 of controlling the air supply fan 110 and the exhaust fan 120 based on the indoor pressure.

In the first indoor pressure control operation S100, if the number of revolutions per minute (RPM) of the exhaust fan 120 is assumed as $R_n$ (n is an integer), the processor 160 may receive the indoor pressure detected from the indoor pressure sensor 155, and if the indoor pressure is less than a first set value (referred to as $C_1$ hereinafter), the processor 160 may control the RPM of the exhaust fan 120 to become lower ($R_{n-1}$, n is an integer), and if the indoor pressure is greater than or equal to a second set value (referred to as $C_2$ hereinafter) greater than the first set value, the processor 160 may control the RPM of the exhaust fan 120 to become higher ($R_{n+1}$, n is an integer).

That is, the processor 160 may identify whether the appropriate indoor pressure of the indoor pressure controlling method according to the disclosure is between $C_1$ and $C_2$. In order to prevent air from being introduced from the outdoors to the indoors, the indoor pressure may be 2.5 Pa or higher, and in order that the user indoors may not feel inconvenience in living, the indoor pressure may be lower than 10 Pa. Therefore, each of $C_1$ and $C_2$ may be 2.5 and 10. However, the values of each of $C_1$ and $C_2$ may be set differently according to the user, the place, and the weather, and they may be changed by the user's setting.

In another embodiment, the sensor part 150 may further include a separate outdoor pressure sensor (not shown), and transmit a relative value of the indoor pressure to the processor 160, and the processor 160 may change $C_1$ and $C_2$ based on the relative value of the pressure.

Specifically, in a weather wherein the outside weather is in a high pressure or the wind is strong, a positive pressure state may be formed when the inside indoor pressure is maintained to be relatively higher, but in contrast, in a weather wherein the outside weather is in a low pressure or the wind is not strong, a positive pressure state may be formed when the inside indoor pressure is maintained to be relatively lower. Therefore, the processor 160 may change $C_1$ and $C_2$ based on the outdoor information.

Hereinafter, a method of controlling the indoor pressure to greater than or equal to $C_1$ and less than $C_2$ in the first indoor pressure control operation S100 will be explained.

The first indoor pressure control operation S100 may proceed to operation of identifying whether the indoor pressure is greater than or equal to $C_1$ (S43). In case the indoor pressure is less than $C_1$, introduction of the outdoor air including fine dust into the indoors may not be prevented effectively. Thus, in the first indoor pressure control operation S100, the RPM of the exhaust fan 120 may be controlled (S101) to become lower ($R_{n-1}$, n is an integer), and the first indoor pressure control operation S100 may proceed to a operation of relatively raising the air supply amount. Then, the first indoor pressure control operation S100 may return to the operation of identifying whether the indoor pressure is greater than or equal to $C_1$ (S43).

In case the indoor pressure rises as the RPM of the exhaust fan 120 is controlled (S101) to become lower, and the indoor pressure is greater than or equal to $C_1$ in the operation of identifying whether the indoor pressure is greater than or equal to $C_1$ (S43), the first indoor pressure control operation S100 may proceed to operation of identifying whether the indoor pressure is less than $C_2$ (S45).

In case the indoor pressure is greater than or equal to $C_2$ in the operation of identifying whether the indoor pressure is less than $C_2$ (S45), the user may feel inconvenience as the indoor pressure is high, and there may be a difficulty in maintaining the indoor pressure. Thus, in the first indoor pressure control operation S100, the RPM of the exhaust fan 120 may be controlled (S103) to become higher ($R_{n+1}$, n is an integer), and the first indoor pressure control operation S100 may proceed to operation of relatively raising the exhaust amount. Then, the first indoor pressure control operation S100 may return to the operation of identifying whether the indoor pressure is greater than or equal to $C_1$ (S43).

Then, in case the indoor pressure is greater than or equal to $C_1$ and less than $C_2$ in the first indoor pressure control operation S100, the first indoor pressure control operation S100 may be finished.

When the first indoor pressure control operation S100 is finished, the controlling method may return to the first detection operation as illustrated in FIG. 3. Alternatively, although not illustrated in the drawings, the air supply fan 110 and the exhaust fan 120 may be controlled such that the exhaust amount of the exhaust fan 120 is identical to the air supply amount of the air supply fan 110, and the controlling method may proceed to the ventilation mode.

In the aforementioned first indoor pressure control operation S100, the RPM of the exhaust fan 120 in the air inflow/outflow apparatus 105 may be adjusted. In the case of raising the RPM of the air supply fan 110 for adjusting the indoor pressure, outdoor fine dust may be introduced indoors through the air supply channel 115, and the replacement cycle of the fine dust filter 117 of the air supply channel 115 may be shortened. Thus, the indoor pressure can be adjusted stably by adjusting the RPM of the exhaust fan 120.

Figure 4:
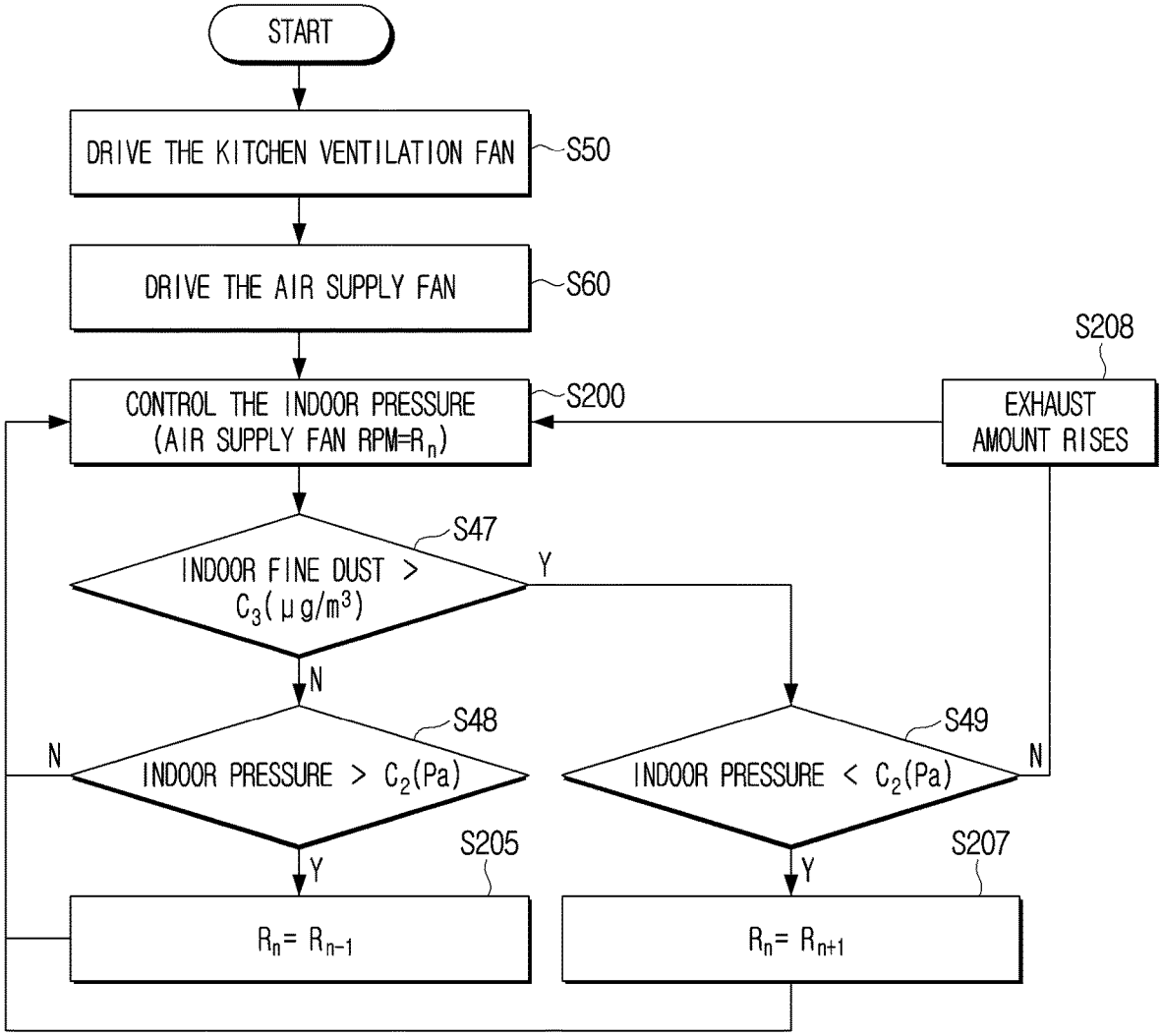
FIG. 4 is a block diagram illustrating a method of controlling an indoor pressure according to an embodiment of the disclosure.

FIG. 4 is a block diagram illustrating a method of controlling an indoor pressure according to an embodiment of the disclosure.

Referring to FIG. 4, the method of controlling an indoor pressure according to the disclosure may include a second indoor pressure control operation S200.

The second indoor pressure control operation S200 may be an indoor pressure controlling method in a situation wherein the kitchen ventilation fan 123 is driven. In case the kitchen ventilation fan 123 was driven (S50) by the user or the setting, the air supply fan is driven (S60) subsequently, and the second indoor pressure control operation S200 proceeds.

The indoor pressure controlling method including the second indoor pressure control operation S200 may be continued after the first indoor pressure control operation S100 of the indoor pressure controlling method in FIG. 3, or it may start independently. Hereinafter, the indoor pressure controlling method including the second indoor pressure control operation S200 will be explained.

The kitchen ventilation fan 123 is included in the exhaust fan 120 as described above, and the indoor pressure controlling method may include a kitchen ventilation operation S50 wherein the kitchen ventilation fan 123 is driven.

In the kitchen ventilation operation S50, the indoor air is sucked in and discharged, and thus the indoor pressure may become lower. Accordingly, the indoors may get in a negative pressure state, and in the negative pressure state, the outdoor air may be introduced into the indoors, and in particular, the outdoor air may be introduced through a different route such as a crack of a structure other than the air supply hole, and in this case, the indoor fine dust level may become higher as the outdoor air does not go through a filter.

Then, when the kitchen ventilation fan 123 is driven (S50), the air supply fan 110 may be driven (S60). As the air supply fan 110 is driven, the indoor pressure may be prevented from getting down to a negative pressure state. Alternatively, in a state wherein the air supply fan 110 is already being driven, the air supply fan 110 may be driven more strongly to correspond to the exhaust amount of the kitchen ventilation fan 123.

The indoor pressure and the indoor fine dust level change by the driving (S60) of the air supply fan 110. In this case, in order to maintain the indoor pressure in a positive pressure state simultaneously by discharging the indoor air smoothly for ventilation of the kitchen 30, the indoor pressure controlling method may proceed to the second indoor pressure control operation S200.

In the second indoor pressure control operation S200, the indoor fine dust level and the indoor pressure may be detected, and the air supply fan 110 and the exhaust fan 120 may be controlled based on the indoor fine dust level and the indoor pressure.

In the second indoor pressure control operation S200, the number of revolutions per minute (RPM) of the air supply fan 110 is assumed as $R_n$ (n is an integer), and the processor 160 may receive the indoor fine dust level detected from the indoor fine dust sensor 157, and identify (S47) whether the indoor fine dust level is greater than or equal to $C_3$. Then, the processor 160 may receive the indoor pressure detected from the indoor pressure sensor 155, and respectively identify whether the indoor pressure is greater than or equal to $C_2$ (S48) or less than $C_2$ (S49).

Hereinafter, a method of controlling an indoor pressure according to the indoor fine dust situation by managing the indoor fine dust level to less than or equal to $C_3$ in the second indoor pressure control operation S200 will be explained.

In the second indoor pressure control operation S200, it may be identified (S47) whether the indoor fine dust level is greater than or equal to $C_3$.

If the indoor fine dust level is less than $C_3$ (S47), it may be identified (S48) whether the indoor pressure is greater than or equal to $C_2$ in the second indoor pressure control operation S200.

If the indoor fine dust level is less than $C_3$, the indoor air is in a clean state, and thus the indoor pressure may be controlled to be maintained to be less than $C_2$ in the second indoor pressure control operation S200 as in the first indoor pressure control operation S100. This operation may be a situation wherein the indoor fine dust level is not high, and at the same time, indoor ventilation is needed through the kitchen ventilation fan 123, and thus attention may be focused on the ventilation effect more than on the indoor pressure.

Therefore, if the indoor fine dust level is less than $C_3$, and the indoor pressure is greater than or equal to $C_2$, the processor 160 may control (S205) the RPM of the air supply fan 110 to become lower, and thereby lower the indoor pressure to less than or equal to $C_2$. Meanwhile, if the indoor fine dust level is less than $C_3$, and the indoor pressure is less than $C_2$, the processor 160 may maintain the RPM of the air supply fan 110 without changing it, and may return to the second indoor pressure control operation S200.

In the second indoor pressure control operation S200, if the indoor fine dust level is greater than or equal to $C_3$ (S47), it may be identified (S49) whether the indoor pressure is less than $C_2$. In this case, if the indoor fine dust level is greater than or equal to $C_3$, the indoor pressure may be controlled to be maintained to be about $C_2$.

If the indoor fine dust level is greater than or equal to $C_3$, and the indoor pressure is less than $C_2$, the processor 160 may control (S207) the RPM of the air supply fan 110 to become higher. As a result, the indoor pressure may increase, and by maintaining a positive pressure state, introduction of the outdoor air including fine dust into the indoors can be prevented. Afterwards, the controlling method may return to the second indoor pressure control operation S200.

Meanwhile, if the indoor fine dust level is greater than or equal to $C_3$, and the indoor pressure is greater than or equal to $C_2$, the processor 160 may increase (S207) the exhaust amount of the exhaust fan 120. As a result, the indoor pressure may decrease to a level that is identical to or smaller than $C_2$, and the controlling method may return to the second indoor pressure control operation S200.

Specifically, a situation wherein the kitchen ventilation fan 123 is driven may be a situation wherein the smoke, the odor, and the heat, etc. of the kitchen 30 should be exhausted to the outside quickly. However, in case the indoor fine dust reaches a level greater than or equal to $C_3$, it may be a situation wherein the outdoor air including fine dust should be prevented from being introduced inside any more, and at the same time, the indoor air and the outdoor air should be continuously exchanged. Therefore, as introduction of the outdoor air into the inside without going through the fine dust filter 117 can be prevented by controlling the indoor pressure to be maintained to be about $C_2$ temporarily and thereby discharging the indoor air to the outside and simultaneously maintaining a positive pressure state, it may be simultaneously effective for air purification management and kitchen ventilation.

The second indoor pressure control operation S200 may be maintained while the kitchen ventilation fan 123 is being driven, and when the driving of the kitchen ventilation fan 123 is finished, indoor pressure control may be finished, or the controlling method may return to the first indoor pressure control operation S100.

Also, the indoor pressure controlling method as described above can be implemented as a program including an algorithm that is executable in a computer, and the program as described above may be provided while being stored in a non-transitory computer readable medium.

A non-transitory computer readable medium refers to a medium that stores data semi-permanently, and is readable by machines, but not a medium that stores data for a short moment such as a register, a cache, and a memory. Specifically, programs for performing the aforementioned various methods may be provided while being stored in a non-transitory computer readable medium such as a CD, a DVD, a hard disc, a blue-ray disc, a USB, a memory card, a ROM, and the like.

Also, while preferred embodiments of the disclosure have been shown and described, the disclosure is not limited to the aforementioned specific embodiments, and it is apparent that various modifications may be made by those having ordinary skill in the technical field to which the disclosure belongs, without departing from the gist of the disclosure as claimed by the appended claims. Further, it is intended that such modifications are not to be interpreted independently from the technical idea or prospect of the disclosure.

What is claimed is:

1. A method of controlling an indoor pressure, the method comprising:

detecting an indoor carbon dioxide level;

detecting an outdoor fine dust level;

driving an air supply fan and an exhaust fan, and controlling an air supply amount of the air supply fan and an exhaust amount of the exhaust fan based on the detected indoor carbon dioxide level and the detected outdoor fine dust level; and performing an indoor pressure control of detecting an indoor pressure, and controlling the air supply fan and the exhaust fan based on the detected indoor pressure, wherein the indoor pressure control is performed in relation to the detected indoor carbon dioxide level and the detected outdoor fine dust level, and the indoor pressure control comprises:

based on the detected indoor pressure being less than a first set value, controlling a number of revolutions per minute of the exhaust fan to be decreased; and based on the detected indoor pressure being greater than or equal to a second set value greater than the first set value, controlling the number of revolutions per minute of the exhaust fan to be increased.

2. The method of controlling an indoor pressure of claim 1, wherein the indoor pressure control comprises:

based on the detected indoor pressure being greater than or equal to the first set value and being less than the second set value, repeating the detecting of the indoor carbon dioxide level, the detecting of the outdoor fine dust level, and the driving of the air supply fan and the exhaust fan based on the detected indoor carbon dioxide level and the detected outdoor fine dust level.

3. The method of controlling an indoor pressure of claim 1, wherein the detecting of the indoor carbon dioxide level comprises:

based on the detected indoor carbon dioxide level being greater than or equal to a predetermined level, the controlling of the air supply amount and the exhaust amount controls the air supply fan and the exhaust fan such that the exhaust amount of the exhaust fan is identical to the air supply amount of the air supply fan.

4. The method of controlling an indoor pressure of claim 1, wherein the detecting of the outdoor fine dust level comprises:

based on the detected outdoor fine dust level being greater than or equal to a predetermined level, turning a fine dust filter in an air supply hole where the air supply fan is located to an on state.

5. The method of controlling an indoor pressure of claim 1, wherein the detecting of the outdoor fine dust level comprises:

receiving the outdoor fine dust level by a communication apparatus.

6. The method of controlling an indoor pressure of claim 1, wherein the indoor pressure control comprises:

detecting an outdoor pressure; and changing the first set value and the second set value based on the indoor pressure and the outdoor pressure.

7. The method of controlling an indoor pressure of claim 6, wherein, in the indoor pressure control, a sensor to detect the indoor pressure and the outdoor pressure is arranged on a door or a window allowing air to flow from indoor to outdoor.

8. The method of controlling an indoor pressure of claim 1, wherein the indoor pressure control is a first indoor pressure control and the exhaust fan includes a kitchen ventilation fan in the kitchen, and the method further comprises:

driving the kitchen ventilation fan;

driving the air supply fan; and performing a second indoor pressure control of detecting the indoor fine dust level and the indoor pressure, and controlling the air supply fan and the exhaust fan based on the indoor fine dust level and the indoor pressure.

9. The method of controlling an indoor pressure of claim 8, wherein the second indoor pressure control comprises:

based on the detected indoor fine dust level being less than a third set value, and the detected indoor pressure being greater than or equal to the second set value, controlling a number of revolutions per minute of the air supply fan to be lowered.

10. The method of controlling an indoor pressure of claim 9, wherein the second indoor pressure control comprises:

based on the detected indoor fine dust level being greater than or equal to the third set value, and the detected indoor pressure being less than the second set value, controlling a number of revolutions per minute of the air supply fan to increase, and based on the detected indoor fine dust level being greater than or equal to the third set value, and the detected indoor pressure being greater than or equal to the second set value, increasing the exhaust amount of the exhaust fan.

11. An air conditioning apparatus comprising:

an air supply fan to introduce air from outdoor to indoor;

an exhaust fan to discharge air from the indoor to outdoor;

a sensor among a plurality of sensors to detect an indoor carbon dioxide level, an outdoor fine dust level, and an indoor pressure; and a processor to control the air supply fan and the exhaust fan based on detected values transmitted from the sensor, wherein the processor controls the air supply fan and the exhaust fan in relation the detected values of the plurality of sensors that detect the indoor carbon dioxide level, the outdoor fine dust level, and the indoor pressure and the processor is configured to:

based on detected levels associated with the detected values transmitted in association with the indoor carbon dioxide and the outdoor fine dust, control the air supply fan and the exhaust fan such that an air supply amount of the air supply fan is greater than an exhaust amount of the exhaust fan, and based on the detected indoor pressure being less than a first set value, control a number of revolutions per minute of the exhaust fan to be decreased, and based on the detected indoor pressure being greater than or equal to a second set value greater than the first set value, control the number of revolutions per minute of the exhaust fan to be increased.

12. The air conditioning apparatus of claim 11, further comprising:

a fine dust filter to be arranged in an air supply hole where the air supply fan is located, the fine dust filter being turned on/off by the processor.

13. The air conditioning apparatus of claim 11, wherein a sensor to detect an outdoor pressure is among the plurality of sensors, and a sensor to detect the indoor pressure and the sensor to detect the outdoor pressure are arranged on a door or a window communicating from the indoors to the outdoors.

14. The air conditioning apparatus of claim 11, wherein the exhaust fan includes a kitchen ventilation fan in the kitchen.

15. The air conditioning apparatus of claim 11, wherein a sensor to detect the indoor fine dust level is among the plurality of sensors.

* * * * *